US011024451B2

(12) United States Patent
Yokoyama et al.

(10) Patent No.: US 11,024,451 B2
(45) Date of Patent: Jun. 1, 2021

(54) MULTILAYER COIL COMPONENT

(71) Applicant: Murata Manufacturing Co., Ltd., Nagaokakyo (JP)

(72) Inventors: Tomoya Yokoyama, Nagaokakyo (JP); Takayuki Okada, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1172 days.

(21) Appl. No.: 15/407,322

(22) Filed: Jan. 17, 2017

(65) Prior Publication Data

US 2017/0125155 A1 May 4, 2017

Related U.S. Application Data

(63) Continuation of application No. PCT/JP2015/067960, filed on Jun. 23, 2015.

(30) Foreign Application Priority Data

Jul. 23, 2014 (JP) ..... JP2014-149360

(51) Int. Cl.
*H01F 27/28* (2006.01)
*H01F 17/00* (2006.01)
(Continued)

(52) U.S. Cl.
CPC ..... *H01F 27/2804* (2013.01); *G05F 3/08* (2013.01); *H01F 17/0013* (2013.01);
(Continued)

(58) Field of Classification Search
CPC ..... H01F 27/2804; H01F 2027/2809; H01F 27/292; H01F 17/006; H01F 17/0013; H01F 2017/002; H01F 27/40
(Continued)

(56) References Cited

U.S. PATENT DOCUMENTS 4,904,967 A * 2/1990 Morii ..... H03H 1/0007 333/167
6,061,227 A * 5/2000 Nogi ..... H01G 4/385 333/185
(Continued)

FOREIGN PATENT DOCUMENTS

JP 02-224513 A 9/1990
JP 06-103650 B2 12/1994
(Continued)

OTHER PUBLICATIONS

Official Communication issued in corresponding International Application PCT/JP2015/067960, dated Sep. 15, 2015.

*Primary Examiner* — Tszfung J Chan
(74) *Attorney, Agent, or Firm* — Keating & Bennett, LLP

(57) ABSTRACT

A multilayer coil component includes coil conductors including silver planar conductors and ferrite layers containing copper and stacked with the coil conductors and the planar conductors interposed therebetween. The coil conductors define a portion of a coil with a winding axis extending in a lamination direction. The planar conductors are arranged in the lamination direction at a position on an upper side of the coil so that each of principal surfaces thereof faces in the lamination direction and a specific region of the principal surface overlaps with the coil when viewed from the lamination direction. Each of the planar conductors includes first through holes penetrating the principal surface in the lamination direction in the specific region.

19 Claims, 5 Drawing Sheets

(51) Int. Cl.
*G05F 3/08* (2006.01)
*H01F 27/29* (2006.01)
*H01F 27/40* (2006.01)

(52) U.S. Cl.
CPC ..... *H01F 27/292* (2013.01); *H01F 27/40* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2002/0158307 | A1* | 10/2002 | Honda | H01G 4/30 257/532 |
| 2009/0002918 | A1* | 1/2009 | Kawasaki | H01G 4/30 361/311 |
| 2012/0236459 | A1* | 9/2012 | Ohira | H01G 4/40 361/270 |

FOREIGN PATENT DOCUMENTS

| | | | | | |
|---|---|---|---|---|---|
| JP | 11-340039 | A | | 12/1999 | |
| JP | 2005167468 | A | * | 6/2005 | H03H 7/0115 |
| JP | 2005183890 | A | * | 7/2005 | |
| JP | 2008-053675 | A | | 3/2008 | |
| JP | 2014-120574 | A | | 6/2014 | |
| WO | WO-2007148556 | A1 | * | 12/2007 | C04B 35/62655 |

* cited by examiner

MULTILAYER COIL COMPONENT

CROSS REFERENCE TO RELATED APPLICATIONS

This application claims the benefit of priority to Japanese Patent Application No. 2014-149360 filed on Jul. 23, 2014 and is a Continuation Application of PCT Application No. PCT/JP2015/067960 filed on Jun. 23, 2015. The entire contents of each application are hereby incorporated herein by reference.

BACKGROUND OF THE INVENTION

1. Field of the Invention

The present invention relates to a multilayer coil component, and more particularly, to a multilayer coil component applied to a DC/DC converter and including a plurality of coil conductors, a plurality of planar conductors containing silver, and a plurality of ferrite layers containing copper and stacked with the plurality of coil conductors and the plurality of planar conductors interposed therebetween. The plurality of coil conductors define a portion of a coil with a winding axis extending in a lamination direction, and the plurality of planar conductors are arranged in the lamination direction at a position in an outer side portion of the coil in the lamination direction so that principal surfaces thereof face in the lamination direction and that specific regions on the principal surfaces overlap with the coil when viewed from the lamination direction.

2. Description of the Related Art

In such a type of multilayer coil component, the pressure for pressure-bonding a multilayer body increases in a region where a plurality of coil conductors overlap when viewed from the lamination direction. This decreases the distance between a plurality of planar conductors in the lamination direction. Here, in a typical DC/DC converter, each of a plurality of planar conductors serves as a ground electrode, a shield electrode, or a capacitance electrode, and a potential difference of the input voltage or the output voltage from the ground potential is generated between the layers. For this reason, some measures, for example, to secure insulation are necessary in the region where the distance between the plural planar conductors is short in the lamination direction.

Japanese Unexamined Patent Application Publication No. 2-224513 discloses that shield electrode layers are provided on surfaces of an LC composite component with sheet layers formed of a dielectric or insulating material interposed therebetween, circular, L-shaped, or linear cavities are provided, and the frequency characteristics are changed according to the shape of the cavities. Japanese Unexamined Patent Application Publication No. 11-340039 also discloses that a slit is provided in at least a part of each shield layer. However, these structures are both directed to problems different from the problem of accumulation of silver and copper between the planar conductors, and are based on greatly different premises.

SUMMARY OF THE INVENTION

Accordingly, preferred embodiments of the present invention provide a multilayer coil component that significantly reduces or prevents accumulation of silver and copper between planar conductors.

A multilayer coil component according to a preferred embodiment of the present invention includes a plurality of coil conductors, a plurality of planar conductors containing silver, and a plurality of ferrite layers containing copper and stacked with the plurality of coil conductors and the plurality of planar conductors interposed therebetween. The plurality of coil conductors define a portion of a coil with a winding axis extending in a lamination direction, and the plurality of planar conductors are arranged in the lamination direction at a position in an outer side portion of the coil in the lamination direction so that each of principal surfaces thereof faces in the lamination direction and a specific region of the principal surface overlaps with the coil when viewed from the lamination direction. Each of the plurality of planar conductors includes a plurality of first through holes penetrating the principal surface in the lamination direction in the specific region.

Preferably, the plurality of planar conductors have a plurality of different potentials.

Preferably, each of the plurality of planar conductors further includes at least one second through hole penetrating the principal surface in the lamination direction in a region different from the specific region.

Preferably, a multilayer body includes the plurality of ferrite layers includes one principal surface on which an electronic component is mounted, and the plurality of planar conductors are provided closer to the one principal surface than the coil.

Preferably, the plurality of coil conductors contain the silver.

When iron oxide serving as a major raw material of the ferrite layers is produced, a sulfur component is mixed therein. The sulfur component reacts with silver due to heat during firing of the multilayer body, and silver sulfide generated by the reaction diffuses inside the multilayer body. Accumulation of the diffusing silver sulfide between the planar conductors may cause electrochemical migration.

While copper contributes to low-temperature sintering of the ferrite layers, cuprous oxide formed by sintering shows the property of a semiconductor. Hence, accumulation of cuprous oxide between the planar conductors may deteriorate insulation between the planar conductors.

As a result, each of the principal surfaces of the plurality of planar conductors includes one, two, or more first through holes penetrating in the lamination direction in the specific region overlapping with the coil when viewed from the lamination direction. This structure significantly reduces or prevents accumulation of silver and copper between the planar conductors.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
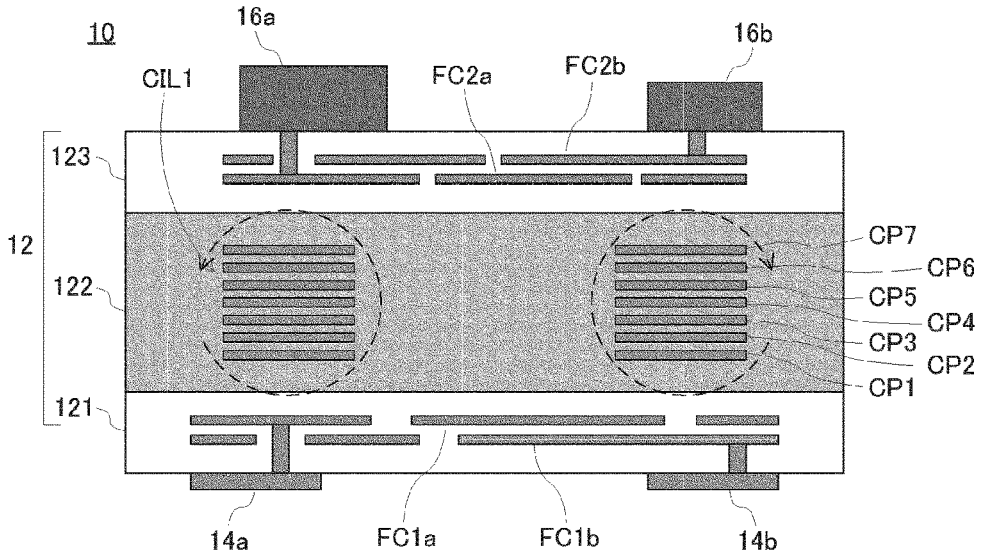
FIG. 1 is a cross-sectional view illustrating a certain cross section (a cross section perpendicular or substantially perpendicular to a depth direction of a rectangular parallelepiped) of a multilayer coil component according to a preferred embodiment of the present invention.
Figure 2A:
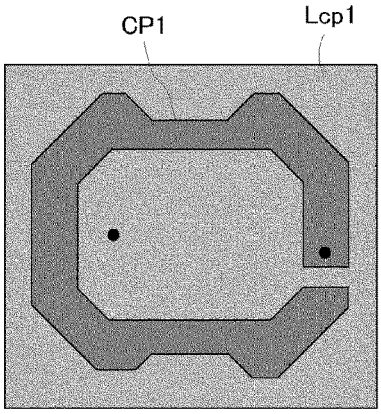
FIG. 2A is a plan view illustrating a ferrite layer of the multilayer coil component and a coil conductor provided on an upper surface of the ferrite layer.
Figure 2B:
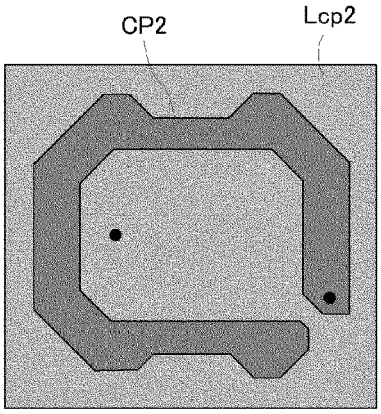
FIG. 2B is a plan view illustrating another ferrite layer of the multilayer coil component and another coil conductor provided on an upper surface of the ferrite layer.
Figure 2C:
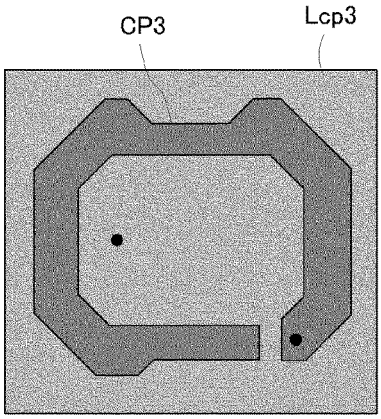
FIG. 2C is a plan view illustrating a further ferrite layer of the multilayer coil component and a further coil conductor provided on an upper surface of the ferrite layer.
Figure 2D:
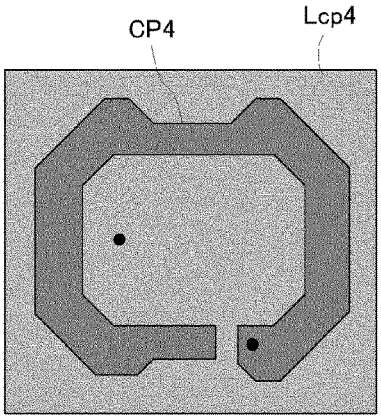
FIG. 2D is a plan view illustrating a still further ferrite layer of the multilayer coil component and a still further coil conductor provided on an upper surface of the ferrite layer.

Referring to FIG. 1, a multilayer coil component (multilayer inductor element) 10 according to a preferred embodiment of the present invention is a multilayer coil component of an LGA (Land Grid Array) type, and includes a multilayer body 12 preferably with a rectangular parallelepiped or substantially rectangular parallelepiped shape. FIG. 1 illustrates a cross section perpendicular or substantially perpendicular to a depth direction of the rectangular parallelepiped or substantially rectangular parallelepiped shape.

A plurality of electronic components 16*a* and 16*b*, such as an IC chip and a capacitor, are mounted on an upper surface (one principal surface) of the multilayer body 12, and outer electrodes 14*a* and 14*b* are provided on a lower surface (the other principal surface) of the multilayer body 12. The electronic components 16*a* and 16*b* are connected to wiring (not illustrated) provided on the upper surface of the multilayer body 12, and this realizes a DC/DC converter.

The multilayer body 12 has a structure in which a nonmagnetic body portion 121, a magnetic body portion 122, and a nonmagnetic body portion 123 are stacked in this order (the nonmagnetic body portions 121 and 123 may be low-magnetic body portions). Planar conductors FC1*a* and FC1*b* are embedded in the nonmagnetic body portion 121, a plurality of coil conductors CP1 to CP7 that define a coil CIL1 are embedded in the magnetic body portion 122, and planar conductors FC2*a* and FC2*b* are embedded in the nonmagnetic body portion 123. Therefore, the planar conductors FC1*a* and FC1*b* are provided on a lower side of the coil CIL1, and the planar conductors FC2*a* and FC2*b* are provided on an upper side of the coil CIL1 (on the side of the one principal surface of the multilayer body 12). In the coil CIL1, a magnetic field is generated in a manner shown by broken lines in FIG. 1.

The nonmagnetic body portion 121, the magnetic body portion 122, and the nonmagnetic body portion 123 are formed preferably by stacking a plurality of ferrite layers including ferrite layers Lcp1 to Lcp7, Lfc2*a*, and LFc2*b* to be described later. Therefore, the planar conductors FC1*a*, FC1*b*, FC2*a*, and FC2*b* and the coil conductors CP1 to CP7 are held between the plural stacked ferrite layers. The ferrite layers that define the nonmagnetic body portions 121 and 123 are nonmagnetic, and the ferrite layers that define the magnetic body portion 122 are magnetic.

In the nonmagnetic body portion 121, the planar conductors FC1*a* and FC1*b* are arranged in the lamination direction such that their principal surfaces face in the lamination direction. Similarly, in the nonmagnetic body portion 123, the planar conductors FC2*a* and FC2*b* are arranged in the lamination direction such that their principal surfaces face in the lamination direction. Here, the planar conductor FC1*a* is connected to the outer electrode 14*a*, and the planar conductor FC1*b* is connected to the outer electrode 14*b*. Also, the planar conductor FC2*a* is connected to the electronic component 16*a*, and the planar conductor FC2*b* is connected to the electronic component 16*b*.

Each of the planar conductors FC1*a*, FC1*b*, FC2*a*, and FC2*b* thus provided defines and functions as any of a ground electrode, a shield electrode, and a capacitance electrode. Therefore, a potential difference is generated between the planar conductors, of the planar conductors FC1*a* and FC1*b* or the planar conductors FC2*a* and FC2*b*, except for the electrodes whose potentials are made equal, for example, by connection through a via-hole conductor.

In the magnetic body portion 122, the coil CIL1 is wound in, for example, seven turns in the lamination direction, and its winding axis extends in the lamination direction. When viewed from the lamination direction, the coil CIL1 overlaps with the principal surfaces of the planar conductors FC1*a*, FC1*b*, FC2*a*, and FC2*b*. Hereinafter, a region overlapping with the coil CIL1 when viewed from the lamination direction, of regions on each principal surface, is defined as a "specific region". A region that does not overlap with the coil CIL1 when viewed from the lamination direction, of the regions on the principal surfaces, is defined as a "non-overlapping region".

Figure 3A:
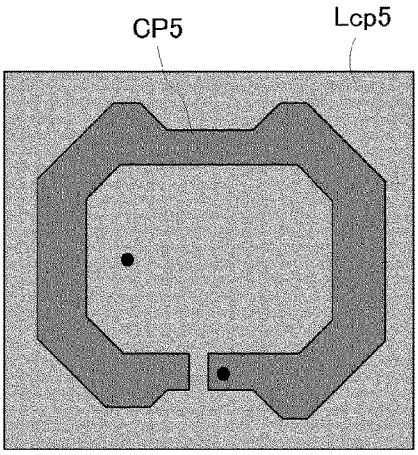
FIG. 3A is a plan view illustrating a further ferrite layer of the multilayer coil component and a further coil conductor provided on an upper surface of the ferrite layer.
Figure 3B:
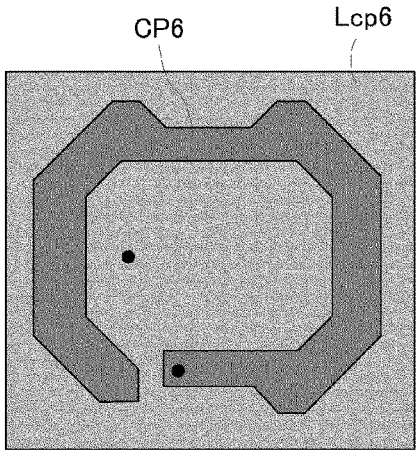
FIG. 3B is a plan view illustrating a still further ferrite layer of the multilayer coil component and a still further coil conductor provided on an upper surface of the ferrite layer.
Figure 3C:
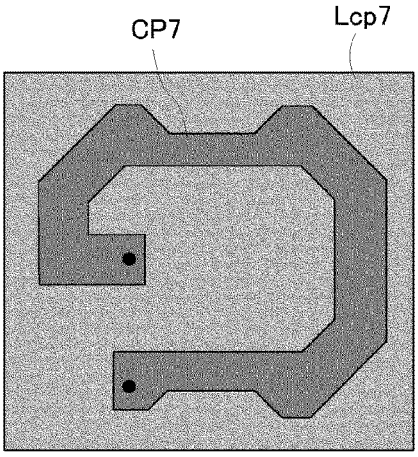
FIG. 3C is a plan view illustrating an even still further ferrite layer of the multilayer coil component and an even still further coil conductor provided on an upper surface of the ferrite layer.

Referring to FIGS. 2A to 2D, the coil conductor CP1 is provided on an upper surface of a magnetic ferrite layer LCp1, the coil conductor CP2 is provided on an upper surface of a magnetic ferrite layer Lcp2, the coil conductor CP3 is provided on an upper surface of a magnetic ferrite layer Lcp3, and the coil conductor CP4 is provided on an upper surface of a magnetic ferrite layer Lcp4. Referring to FIGS. 3A to 3C, the coil conductor CP5 is provided on an upper surface of a magnetic ferrite layer Lcp5, the coil conductor CP6 is provided on an upper surface of a magnetic ferrite layer Lcp6, and the coil conductor CP7 is provided on an upper surface of a magnetic ferrite layer Lcp7.

All the coil conductors CP1 to CP7 define a C-shaped or substantially C-shaped pattern (a pattern shaped like a partly missing ring) when viewed from the lamination direction. However, the position where the conductor is missing is different among the coil conductors CP1 to CP7. A plurality of black dots shown in FIGS. 2A to 2D and 3A to 3C show via-hole conductors, and the coil conductors CP1 to CP7 are connected in a helical shape by these via-hole conductors. Thus, the coil CIL1 having the winding axis extending in the lamination direction is provided, and both ends of the coil CIL1 appear on the lower surface of the magnetic body portion 122.

The coil CIL1 with the structure described above is appropriately connected to the planar conductors FC1*a*, FC1*b*, FC2*a*, and FC2*b*, the outer electrodes 14*a* and 14*b*, or the electronic components 16*a* and 16*b* by via-hole conductors or side surface conductors that are not illustrated.

Figure 4A:
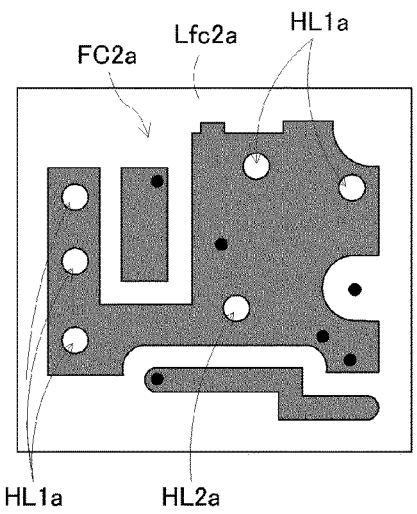
FIG. 4A is a plan view illustrating a ferrite layer of the multilayer coil component and a planar conductor provided on an upper surface of the ferrite layer.
Figure 4B:
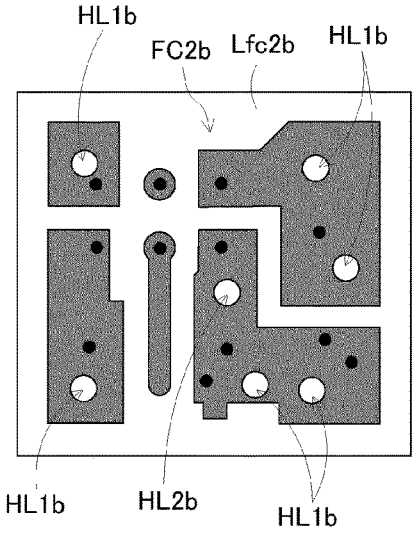
FIG. 4B is a plan view illustrating another ferrite layer of the multilayer coil component and another planar conductor provided on an upper surface of the ferrite layer.

Referring to FIGS. 4A and 4B, the planar conductor FC2*a* is provided on an upper surface of a nonmagnetic ferrite layer Lfc2*a*, and the planar conductor FC2*b* is provided on an upper surface of a nonmagnetic ferrite layer Lfc2*b*. The planar conductors FC2*a* and FC2*b* have different patterns according to the functions thereof. In principal surfaces of the planar conductor FC2*a*, a plurality of first through holes HL1*a* and a single second through hole HL2*a* are provided. Similarly, in principal surfaces of the planar conductor FC2*b*, a plurality of first through holes HL1*b* and a single second through hole HL2*b* are provided.

Figure 5A:
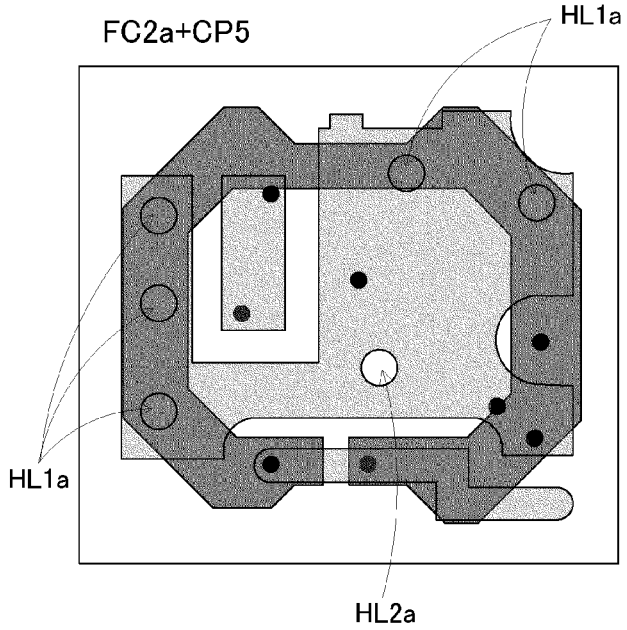
FIG. 5A illustrates a state in which the planar conductor FC2*a* is superposed on the coil conductor CP5.
Figure 5B:
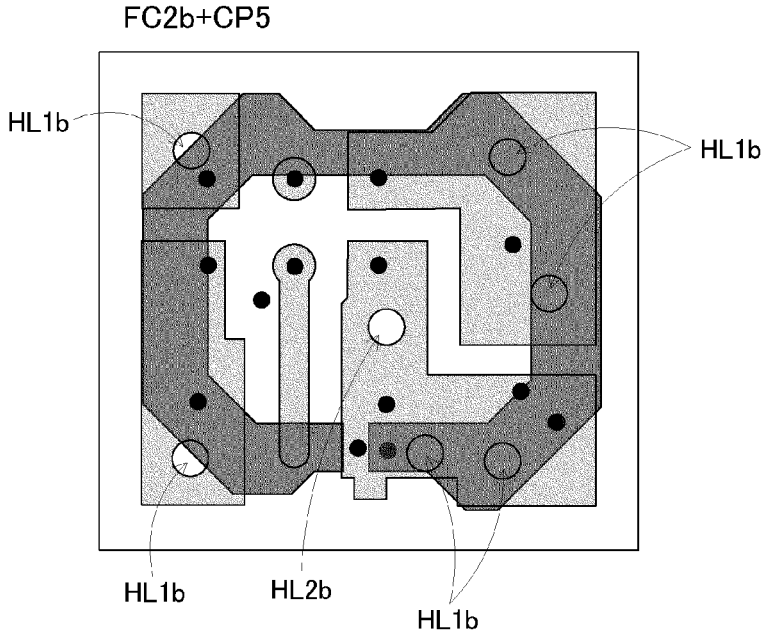
FIG. 5B illustrates a state in which the planar conductor FC2*b* is superposed on the coil conductor CP5.

FIG. 5A illustrates a state in which the planar conductor FC2*a* is superposed on the coil conductor CP5, and FIG. 5B illustrates a state in which the planar conductor FC2*b* is superposed on the coil conductor CP5. According to FIGS. 5A and 5B, the first through holes HL1*a* and HL1*b* are provided in the specific region when viewed from the lamination direction (or at least one or some of the first through holes HL1*a* and HL1*b* are provided in the specific region), and the second through holes HL2*a* and HL2*b* are provided in the non-overlapping region when viewed from the lamination direction.

Here, while it does not matter how the first through holes HL1*a* and HL1*b* and the second through holes HL2*a* and HL2*b* are shaped, the through holes preferably have a ϕ shape to significantly reduce or prevent heat generation resulting from the decrease in cross-sectional area of the portion where the current flows. The hole diameter is adjusted to about 0.05 to about 1.0 mm, and as many holes as possible are formed, for example. The holes are the smallest possible holes to be formed by screen printing. Therefore, a plurality of second through holes HL2*a* may be provided in the non-overlapping region of the planar conductor FC2*a*. Similarly, a plurality of second through holes HL2*b* may be provided in the non-overlapping region of the planar conductor FC2*b*. Alternatively, the second through holes HL2*a* and HL2*b* may be omitted.

As for the distribution of the first through holes HL1*a* and HL1*b* and the second through holes HL2*a* and HL2*b*, the distribution density in the specific region is higher than the distribution density in the non-overlapping region.

Specifically, it is preferable that the ratio of the area of the first through holes HL1*a* and the second through hole HL2*a* to the area of the region surrounded by the outline of the planar conductor FC2*a* is within a range of about 5% to about 30% and that not less than about 70% of the total area of the first through holes HL1*a* and the second through hole HL2*a* is in the specific region, for example.

Similarly, it is preferable that the ratio of the area of the first through holes HL1*b* and the second through hole HL2*b* to the area of the region surrounded by the outline of the planar conductor FC2*b* is within a range of about 5% to about 30% and that not less than about 70% of the total area of the first through holes HL1*b* and the second through hole HL2*b* is within the specific region, for example. However, the positions of the first through holes HL1*a* and HL1*b* provided in the specific region do not need to be aligned with each other when viewed from the lamination direction.

The upper limit of "about 30%" is set to prevent deterioration of the functions of the planar conductors FC2*a* and FC2*b* (that is, the shield function in the case of the shield electrode) and to prevent heat generation of the planar conductors FC2*a* and FC2*b* resulting from the decrease in cross-sectional area of the portion where the current flows. That is, the original functions of the planar conductors FC2*a* and FC2*b* are set as a premise, and the first through holes HL1*a* and HL1*b* and the second through holes HL2*a* and HL2*b* are within a range such as not to impair the functions.

Although not illustrated, the planar conductors FC1*a* and FC1*b* have different patterns according to the functions thereof, similarly to the planar conductors FC2*a* and FC2*b*. Also, first through holes and a second through hole are provided in principal surfaces of each of the planar conductors FC1*a* and FC1*b*. Similarly to the above, the first through holes are provided in the specific region, and the second through hole is provided in the non-overlapping region.

The planar conductors FC1*a*, FC1*b*, FC2*a*, and FC2*b* and the coil conductors CP1 to CP7 contain silver, and a plurality of ferrite layers including the ferrite layers Lcp1 to Lcp7, Lfc2*a*, and Lfc2*b* contain copper.

More specifically, the planar conductors FC1*a*, FC1*b*, FC2*a*, and FC2*b* and the coil conductors CP1 to CP7 preferably are mainly composed of conductive paste containing silver such as Ag, Ag—Pd, or Ag—Pt. The ferrite layers that define the nonmagnetic body portions 121 and 123 preferably are mainly composed of ferrite powder containing copper such as Zn—Cu-based ferrite powder, and the ferrite layers that define the magnetic body portion 122 preferably are mainly composed of ferrite powder containing copper such as Ni—Zn—Cu-based or Ni—Mn—Cu-based ferrite powder.

The multilayer body 12 is preferably produced as follows. First, green sheets serving as bases of the above-described ferrite layers are formed by applying slurry containing the above-described ferrite powder in the sheet form. Next, via holes are formed at predetermined positions in the green sheets by using a laser beam machine, and the via holes are filled with the above-described conductive paste. Further, the above-described conductive paste is applied on the green sheets by screen printing to form patterns serving as bases of planar conductors FC1*a*, FC1*b*, FC2*a*, and FC2*b* or coil conductors CP1 to CP7.

As a result of screen printing, holes corresponding to first through holes HL1*a* and a second through hole HL2*a* are formed in the pattern serving as the base of the planar conductor FC2*a*, and holes corresponding to first through holes HL1*b* and a second through hole HL2*b* are formed in the pattern serving as the base of the planar conductor FC2*b*. In each of the planar conductors FC1*a* and FC1*b*, similar holes corresponding to first through holes and a second through hole are formed.

The plural green sheets in which the conductive paste is filled or applied by printing are stacked and pressure-bonded so that a coil CIL1 having a winding axis extending in the lamination direction is formed, the planar conductors FC1*a* and FC1*b* are provided on a lower side of the coil CIL1, and the planar conductors FC2*a* and FC2*b* are provided on an upper side of the coil CIL1. By subjecting a green multilayer body thus produced to firing and plating, the above-described multilayer body 12 is obtained.

The conductive paste serving as the base of the planar conductors FC1*a*, FC1*b*, FC2*a*, and FC2*b* and the coil conductors CP1 to CP7 is fired simultaneously with firing of the green sheets (co-fire). On the other hand, outer electrodes 14*a* and 14*b* may be formed by co-firing similarly to the conductive paste, or may be formed by application and baking on the multilayer body 12 obtained by sintering (post-fire). The firing atmosphere is not particularly limited, and may be, for example, an oxidation atmosphere or a reducing atmosphere in both cases of co-firing and post-firing.

A multilayer coil component 10 is completed by mounting electronic components 16*a* and 16*b* on an upper surface of the multilayer body 12 thus produced.

Silver contained in the conductive paste is fired near approximately 900° C., for example, whereas copper is contained in the ferrite powder so that the green sheets are sintered at a low temperature in accordance with the firing temperature of silver. When copper is included, the sintering temperature decreases to a temperature that enables co-firing with silver.

However, when the green multilayer body is produced by stacking and pressure-bonding, the pressure in pressure-bonding increases in the region where the coil conductors CP1 to CP7 overlap together when viewed from the lamination direction, that is, in the specific region. This decreases the distance between the planar conductors FC1*a* and FC1*b* or the distance between the planar conductors FC2*a* and FC2*b* in the lamination direction.

Here, when iron oxide serving as the major raw material of ferrite is produced, a sulfur component is mixed therein. The sulfur component reacts with silver due to heat generated in firing of the green multilayer body, and silver sulfide generated by the reaction diffuses inside the multilayer body. Accumulation of the diffusing silver sulfide between the planar conductors FC1*a* and FC1*b* or between the planar conductors FC2*a* and FC2*b* may cause electrochemical migration. Further, when the coil conductors CP1 to CP7 also contain silver, the silver diffuses in the multilayer body during firing. Therefore, the risk of electrochemical migration is increased further.

While copper contributes to low-temperature sintering of the ferrite material, cuprous oxide generated by sintering has the property of a semiconductor. Hence, accumulation of cuprous oxide between the planar conductors FC1*a* and FC1*b* or between the planar conductors FC2*a* and FC2*b* may deteriorate insulation between the planar conductors FC1*a* and FC1*b* or between the planar conductors FC2*a* and FC2*b*.

In any case, the distance between the planar conductors FC2*a* and FC2*b* is decreased in the lamination direction in the specific region. Hence, the above-described problems are likely to arise.

Accordingly, in this preferred embodiment, the first through holes HL1*a* and HL1*b* penetrating the principal surfaces in the specific region are provided in the planar conductors FC2*a* and FC2*b*, and similar first through holes are provided in the planar conductors FC1*a* and FC1*b*. Thus, the first through holes function as holes to significantly reduce or prevent accumulation of silver and copper (for diffusion silver and copper to the outside), and significantly reduce or prevent substances that lower reliability (especially AgS and $Cu_2O$) from accumulating between the layers between which the withstand voltage is applied. For this reason, it is unnecessary to provide the ferrite layers with a thickness more than or equal to the precisely required thickness, and it is also unnecessary to evaluate performance of each multilayer coil component 10.

For comparison, a multilayer coil component 10' having a structure similar to that of the multilayer coil component 10 of this preferred embodiment of the present invention except that the first through holes and the second through holes were not provided was prepared, and was subjected to reliability evaluation (PCBT: thickness between layers with different potentials; 25 μm, withstand voltage; 20 V, number of samples; 200 for each component). While the reliability NG rate of the multilayer coil component 10' in the comparative example was 5%, the multilayer coil component 10 of this preferred embodiment did not have such a reliability NG rate. This result shows that the multilayer coil component 10 of this preferred embodiment of the present invention has higher reliability.

In the multilayer coil component 10 of the present preferred embodiment of the present invention, not less than about 70% of the total area of the first through holes and the second through hole is in the specific region. When the area ratio was about 60%, the reliability NG rate was about 2%. Therefore, it is considered that not less than about 70% of the total area of the first through holes and the second through hole is preferably provided in the specific region.

This preferred embodiment is intended to the multilayer coil component 10 of a closed magnetic circuit type in which the magnetic body portion 122 is provided all between the nonmagnetic body portions 121 and 123. However, the present invention can also be applied to a multilayer coil component of an open magnetic circuit type in which one or some of a plurality of ferrite layers that define the magnetic body portion 122 are nonmagnetic layers.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A multilayer coil component comprising:

a plurality of coil conductors;

a plurality of planar conductors containing silver; and a plurality of ferrite layers containing at least one of copper and sulfur and stacked with the plurality of coil conductors and the plurality of planar conductors interposed therebetween; wherein the plurality of coil conductors define a portion of a coil with a winding axis extending in a lamination direction;

the plurality of planar conductors are arranged in the lamination direction at a position in an outer side portion of the coil in the lamination direction so that each of principal surfaces thereof faces in the lamination direction and a specific region of each of the principal surfaces overlaps with the coil when viewed from the lamination direction;

each of the plurality of planar conductors includes a plurality of first through holes penetrating each of the principal surfaces in the lamination direction in the specific region; and a distribution density of the plurality of first through holes is higher in the specific region than a distribution density of the plurality of first through holes in a region outside of the specific region.

2. The multilayer coil component according to claim 1, wherein the plurality of planar conductors have a plurality of different potentials.

3. The multilayer coil component according to claim 1, wherein each of the plurality of planar conductors further includes at least one second through hole penetrating the principal surface in the lamination direction in a region different from the specific region.

4. The multilayer coil component according to claim 1, wherein a multilayer body including the plurality of ferrite layers includes one principal surface on which an electronic component is mounted; and the plurality of planar conductors are provided closer to the one principal surface than the coil.

5. The multilayer coil component according to claim 1, wherein the plurality of coil conductors contain the silver.

6. The multilayer coil component according to claim 3, wherein a ratio of an area of the plurality of first through holes and the at least one second through hole to an area of each of the plurality of planar conductors is within a range of about 5% to about 30%, and not less than about 70% of a total area of the plurality of first through holes and the at least one second through hole is in the specific region.

7. The multilayer coil component according to claim 1, wherein the multilayer coil component is a multilayer inductor element.

8. The multilayer coil component according to claim 1, wherein the multilayer coil component has a Land Grid Array structure.

9. The multilayer coil component according to claim 4, wherein the multilayer body has a rectangular parallelepiped or substantially rectangular parallelepiped shape.

10. A DC/DC converter comprising:

a multilayer body including:

a plurality of coil conductors;

a plurality of planar conductors containing silver; and a plurality of ferrite layers containing at least one of copper and sulfur and stacked with the plurality of coil conductors and the plurality of planar conductors interposed therebetween; wherein the plurality of coil conductors define a portion of a coil with a winding axis extending in a lamination direction;

the plurality of planar conductors are arranged in the lamination direction at a position in an outer side portion of the coil in the lamination direction so that each of principal surfaces thereof faces in the lamination direction and a specific region of each of the principal surfaces overlaps with the coil when viewed from the lamination direction;

each of the plurality of planar conductors includes a plurality of first through holes penetrating each of the principal surfaces in the lamination direction in the specific region; and a distribution density of the plurality of first through holes is higher in the specific region than a distribution density of the plurality of first through holes in a region outside of the specific region;

at least one electronic component mounted on a first principal surface of the multilayer body; and at least one outer electrode mounted on a second principal surface of the multilayer body.

11. The DC/DC converter according to claim 10, wherein the plurality of planar conductors are provided closer to the first principal surface than the coil.

12. The DC/DC converter according to claim 10, wherein the at least one electronic component includes one of an IC chip and a capacitor.

13. The DC/DC converter according to claim 10, wherein the plurality of planar conductors have a plurality of different potentials.

14. The DC/DC converter according to claim 10, wherein each of the plurality of planar conductors further includes at least one second through hole penetrating the principal surface in the lamination direction in a region different from the specific region.

15. The DC/DC converter according to claim 10, wherein the plurality of coil conductors contain the silver.

16. The DC/DC converter according to claim 14, wherein a ratio of an area of the plurality of first through holes and the at least one second through hole to an area of each of the plurality of planar conductors is within a range of about 5% to about 30%, and not less than about 70% of a total area of the plurality of first through holes and the at least one second through hole is in the specific region.

17. The DC/DC converter according to claim 10, wherein the multilayer body defines a multilayer inductor element.

18. The DC/DC converter according to claim 10, wherein the multilayer coil body has a Land Grid Array structure.

19. The DC/DC converter according to claim 10, wherein the multilayer body has a rectangular parallelepiped or substantially rectangular parallelepiped shape.

* * * * *